US007236345B1

(12) United States Patent
Roesler et al.

(10) Patent No.: US 7,236,345 B1
(45) Date of Patent: Jun. 26, 2007

(54) COMPACT MONOLITHIC CAPACITIVE DISCHARGE UNIT

(75) Inventors: Alexander W. Roesler, Tijeras, NM (US); George E. Vernon, Rio Rancho, NM (US); Darren A. Hoke, Albuquerque, NM (US); Virginia K. De Marquis, Tijeras, NM (US); Steven M. Harris, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 614 days.

(21) Appl. No.: 10/729,614

(22) Filed: Dec. 4, 2003

(51) Int. Cl.
*F23Q 3/00* (2006.01)

(52) U.S. Cl. ..... 361/247

(58) Field of Classification Search ..... 361/247, 361/256

See application file for complete search history.

(56) References Cited

U.S. PATENT DOCUMENTS 5,341,742 A 8/1994 Alford et al. ..... 102/202.8
5,367,428 A 11/1994 Aresco et al. ..... 361/251
5,444,598 A 8/1995 Aresco ..... 361/253
5,543,644 A * 8/1996 Abt et al. ..... 257/295
5,992,401 A * 11/1999 Bylsma et al. ..... 123/596
6,198,374 B1 3/2001 Abel ..... 336/200
6,386,108 B1 5/2002 Brooks et al. ..... 102/217
6,591,754 B1 7/2003 Baur et al. ..... 102/207

OTHER PUBLICATIONS

Slama, George, "Low-Temp Co-Fired magnetic Tape Yields High Benefits", Jan. 2003, Power Electronics Technology, pp. 30-34.

* cited by examiner

*Primary Examiner*—Stephen W. Jackson
(74) *Attorney, Agent, or Firm*—John P. Hohimer

(57) ABSTRACT

A compact monolithic capacitive discharge unit (CDU) is disclosed in which a thyristor switch and a flyback charging circuit are both sandwiched about a ceramic energy storage capacitor. The result is a compact rugged assembly which provides a low-inductance current discharge path. The flyback charging circuit preferably includes a low-temperature co-fired ceramic transformer. The CDU can further include one or more ceramic substrates for enclosing the thyristor switch and for holding various passive components used in the flyback charging circuit. A load such as a detonator can also be attached directly to the CDU.

24 Claims, 8 Drawing Sheets

COMPACT MONOLITHIC CAPACITIVE DISCHARGE UNIT

GOVERNMENT RIGHTS

This invention was made with Government support under Contract No. DE-AC04-94AL85000 awarded by the U.S. Department of Energy. The Government has certain rights in the invention.

FIELD OF THE INVENTION

The present invention relates in general to capacitive discharge units (CDUs) for electrical energy storage and release, and in particular to a compact rugged CDU formed by monolithically integrating an energy storage capacitor together with a semiconductor thyristor switch and a flyback charging circuit.

BACKGROUND OF THE INVENTION

Capacitive discharge units (CDUs) find use in a variety of applications where a short burst of a large electrical current is required. This includes the initiation of detonators for commercial or military applications, the initiation of flashlamps, the initiation of plasma discharges, etc. Conventional CDUs are generally not very rugged or compact and thus are not usable for certain applications having size constraints or requiring shock resistance. Additionally, the inductance in wiring between a conventional CDU and a load can stretch out the time over which the electrical current is discharged thereby limiting the attainment of a fast current discharge pulse which is required for certain applications.

The present invention provides an improvement over the prior art by providing a capacitive discharge unit (CDU) as a monolithic assembly that includes a parallel-plate ceramic capacitor for storing electrical energy and a semiconductor switch (e.g. a thyristor switch) attached onto one side of the capacitor to provide a low-inductance current path for discharge of the capacitor. A flyback charging circuit comprising a transformer and a semiconductor diode is attached onto the other side of the ceramic capacitor.

The monolithic CDU of the present invention can be formed as a compact and rugged assembly for use in space-critical applications, and for applications requiring shock resistance.

These and other advantages of the present invention will become evident to those skilled in the art.

SUMMARY OF THE INVENTION

The present invention relates to a capacitive discharge unit (CDU) which comprises a ceramic capacitor for storing electrical energy; a thyristor switch attached onto one side of the ceramic capacitor and electrically connected thereto to discharge the electrical energy stored within the ceramic capacitor in response to a trigger signal provided to a gate of the thyristor switch; and a flyback charging circuit comprising a transformer (e.g. a low-temperature co-fired ceramic transformer) and a diode and which are attached onto the side of the ceramic capacitor opposite the thyristor switch to provide the electrical energy to the ceramic capacitor for storage therein. The CDU can further comprise a ceramic frame surrounding the thyristor switch, with the ceramic frame being attached onto the ceramic capacitor. A ceramic lid can also be attached onto the frame to enclose the thyristor switch. The ceramic frame and lid can each include electrical conductors formed thereon or therein to conduct the electrical energy stored within the ceramic capacitor through the thyristor switch to a pair of output terminals formed on an outer surface of the ceramic lid. A load (e.g. a detonator) can be attached directly between the pair of output terminals on the ceramic lid.

The present invention also relates to a CDU which comprises a ceramic capacitor having a pair of substantially coplanar major surfaces; a thyristor switch attached onto one major surface of the ceramic capacitor, with the thyristor switch being electrically connected to the ceramic capacitor to discharge any electrical energy stored therein through the thyristor switch in response to a trigger signal provided to a gate electrode of the thyristor switch; and a flyback transformer attached onto another major surface of the ceramic capacitor and electrically connected thereto through a semiconductor diode to provide electrical energy to charge the ceramic capacitor.

The thyristor switch can comprise a metal-oxide-semiconductor (MOS) controlled thyristor switch; and the flyback transformer can comprise a low-temperature co-fired ceramic (LTCC) transformer. The CDU can further comprise a frame that surrounds the thyristor switch and is attached onto the major surface of the ceramic capacitor whereon the thyristor switch is located. A lid can be attached onto the frame to enclose the thyristor switch. The frame and lid can each comprise a ceramic material and can further include a plurality of electrical conductors (also referred to herein as a patterned metallization) to conduct the electrical energy discharged from the ceramic capacitor to a pair of output terminals provided on an outer surface of the lid. A load (e.g. a detonator) can be optionally attached onto the lid between the pair of output terminals.

The present invention further relates to a CDU which comprises a substantially planar ceramic capacitor having two major surfaces; a low-temperature co-fired ceramic (LTCC) transformer attached onto a major surface of the ceramic capacitor and electrically connected thereto through a semiconductor diode to electrically charge the ceramic capacitor; and a thyristor switch attached onto another major surface of the ceramic capacitor opposite the LTCC transformer, with the thyristor switch being electrically connected to discharge the ceramic capacitor upon triggering of the thyristor switch. The CDU can further comprise a first ceramic substrate for attaching the LTCC transformer to the ceramic capacitor, with the first ceramic substrate including a patterned metallization for electrically connecting the LTCC transformer and the semiconductor diode to the ceramic capacitor.

A second ceramic substrate (also referred to herein as a ceramic lid) can be located on a side of the thyristor switch opposite the ceramic capacitor, with the second ceramic substrate having a patterned metallization through which the ceramic capacitor can be discharged upon triggering of the thyristor switch. The second ceramic substrate can also include a pair of output terminals for the attachment of a load (e.g. a detonator) which can be energized upon discharge of the ceramic capacitor. A third ceramic substrate (also referred to herein as a ceramic frame) can be provided between the second ceramic substrate and the ceramic capacitor to enclose the thyristor switch, with the third ceramic substrate further providing an electrical connection between the ceramic capacitor and the second ceramic substrate.

The present invention also relates to a CDU which comprises a monolithic stacked assembly including a ceramic capacitor sandwiched between a low-temperature co-fired ceramic (LTCC) transformer and a metal-oxide-semiconductor controlled thyristor (MCT) switch, with the LTCC transformer being electrically connected to charge the ceramic capacitor through a semiconductor diode located therebetween, and with the MCT switch being triggerable to discharge the capacitor.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1:
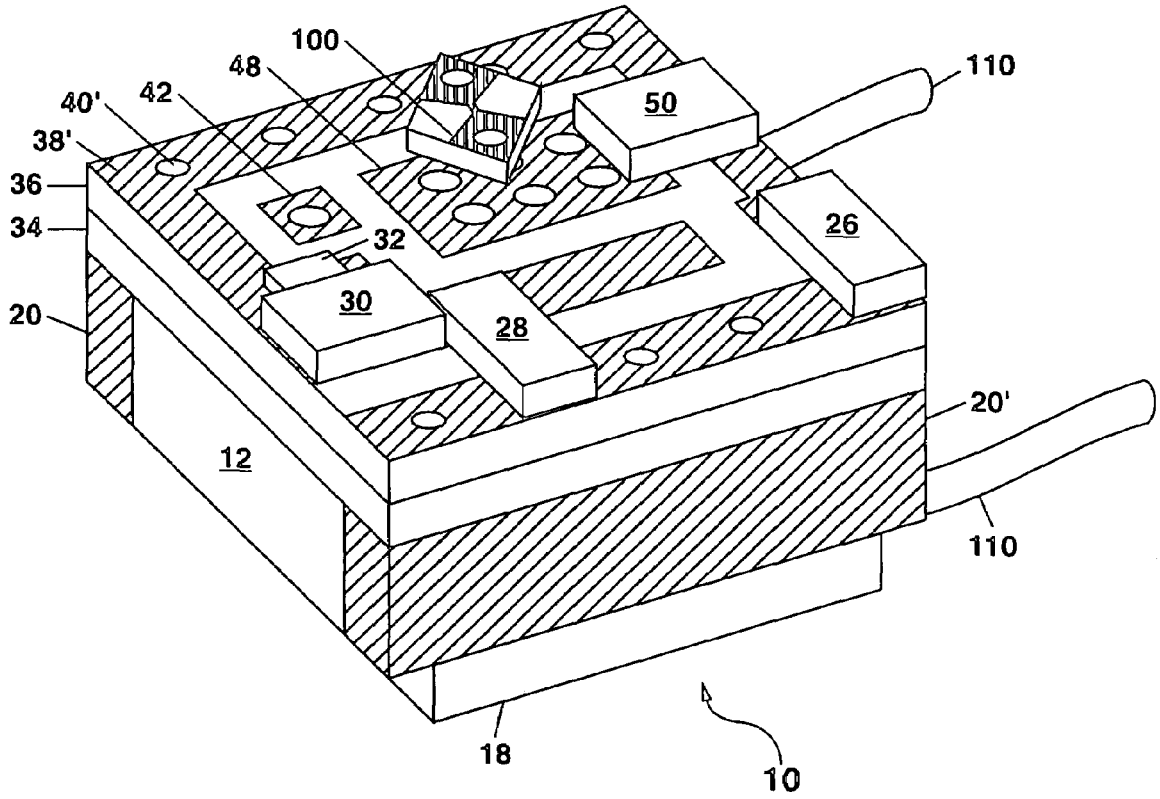
FIG. 1 shows a first embodiment of a monolithic capacitive discharge unit (CDU) formed according to the present invention.
Figure 2:
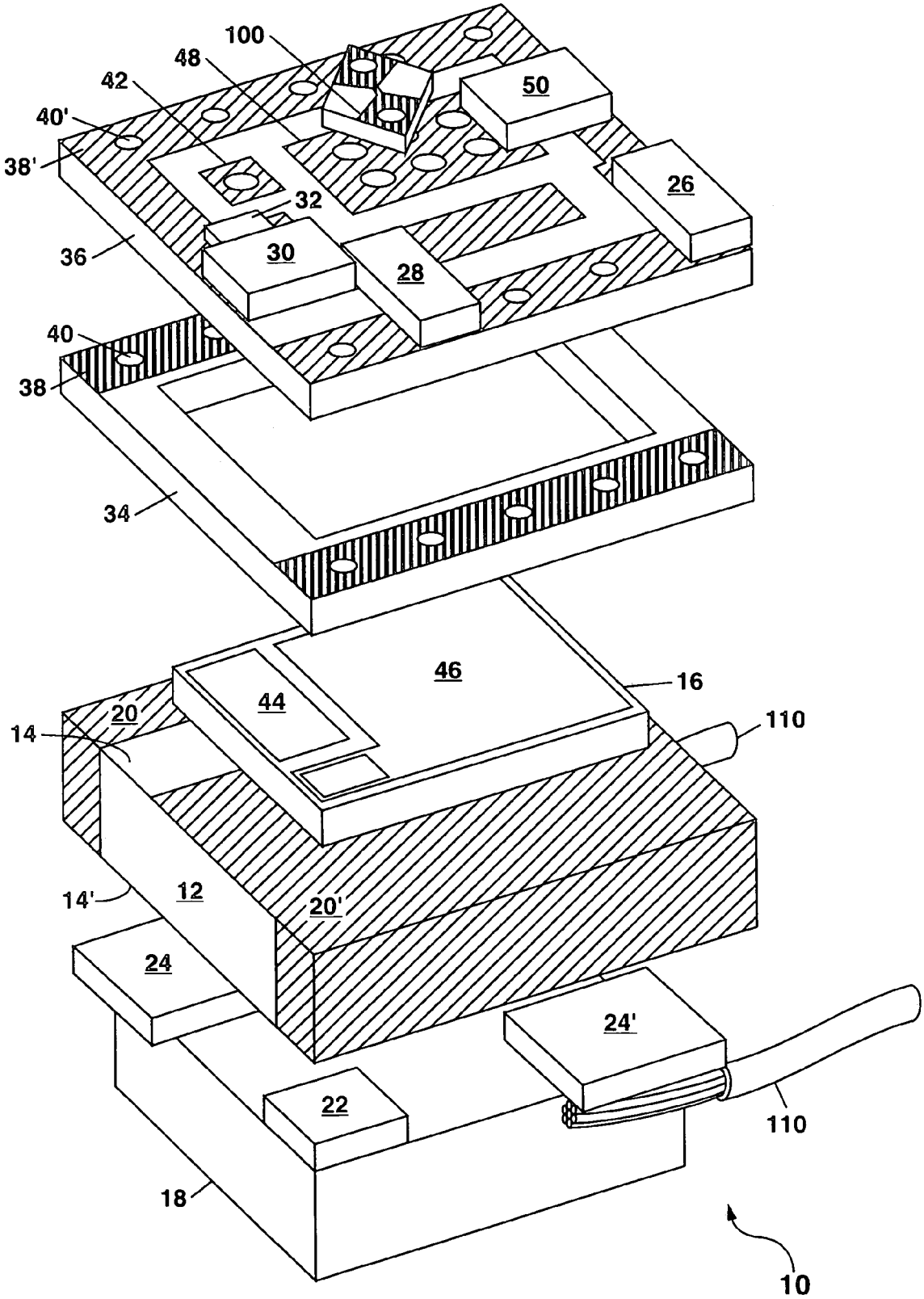
FIG. 2 shows an exploded view of the first embodiment of the CDU of the present invention in FIG. 1.

Referring to FIG. 1, there is shown a schematic perspective view of a first embodiment of a monolithic capacitive discharge unit (CDU) 10 formed according to the present invention; and FIG. 2 shows an exploded view of the CDU 10 of FIG. 1. In FIGS. 1 and 2, the CDU 10 comprises a ceramic capacitor 12 for storing electrical energy, with the ceramic capacitor 12 having a pair of major surfaces 14 and 14' whereon various elements of the CDU 10 can be attached to form a monolithic assembly which provides a low-inductance current path for discharge of the ceramic capacitor 12. A thyristor switch 16 is attached onto one major surface 14 of the ceramic capacitor 12, and a transformer 18 is attached onto the other major surface 14'.

In FIGS. 1 and 2, the ceramic capacitor 12 (indicated as $C_1$ in FIG. 3) comprises a plurality of alternating metal plates which are stacked up and separated by an intervening dielectric material to form two sets of plates, with one set of plates being electrically connected to an electrode 20 on one side of the ceramic capacitor; and with the other set of plates being electrically connected to another electrode 20' on an opposite side of the ceramic capacitor 12. Each electrode 20 and 20' can further extend at least partway over the major surfaces 14 and 14' of the ceramic capacitor 12 as shown in FIG. 2. In FIG. 2, the electrode 20 corresponds to a low-voltage or ground side of the ceramic capacitor 12; and the electrode 20' corresponds to a high-voltage side of the ceramic capacitor 12. The ceramic capacitor 12 can, in some instances, be a commercial-off-the-shelf (COTS) component. The ceramic capacitor 12 can further comprise a high-voltage dielectric material such as lead lanthanum zirconate titanate (also termed $(Pb,La)(Zr,Ti)O_3$ or PLZT). The ceramic capacitor 12 can have a capacitance $C_1$ on the order of 0.1-0.2 microFarads (μF), for example.

In FIGS. 1 and 2, the transformer 18 (indicated as $T_1$ in FIG. 3) can be electrically connected to charge the ceramic capacitor 12 through a high-voltage semiconductor diode 22 which can be attached (e.g. with solder or an electrically-conductive epoxy) between a high-voltage (i.e. secondary) output terminal on the transformer 18 and the high-voltage side 20' of the ceramic capacitor 12. A low-voltage or ground side of the secondary output terminal of the transformer 18 can be connected to the low-voltage side 20 of the ceramic capacitor 12 through a metallized spacer 24 (e.g. a metallized ceramic spacer) which generally has substantially the same thickness as the semiconductor diode 22, and which can be attached between the transformer 18 and the ceramic capacitor 12 in the same manner as the semiconductor diode 22. Additional metallized spacers 24' can be located between a pair of low-voltage (i.e. primary) input terminals of the transformer 18 and the ceramic capacitor 12 as needed to securely attach these elements together to form a rugged monolithic assembly. Certain of the spacers 24 and 24' can be metallized on both sides thereof to connect a secondary winding of the transformer 18 to the electrodes 20 and 20' on the ceramic capacitor 12, while other of the spacers 24 and 24' can be metallized only on a side thereof facing the transformer 18 so that these spacers can be used to connect external wires 110 to a primary winding of the transformer 18.

An alternating-current (ac) voltage (e.g. 12-120 V ac) can be provided to the transformer at an input side thereof (i.e. a primary winding) with an output side (i.e. a secondary winding) of the transformer 18 being adapted to provide a high ac voltage (e.g. 500-2000 V ac) which can then be rectified by the semiconductor diode 22 and used to charge the ceramic capacitor 12 to about the same direct-current (dc) level. The ac voltage can be generated from a dc source (e.g. a battery) by using an oscillator circuit.

Figure 3:
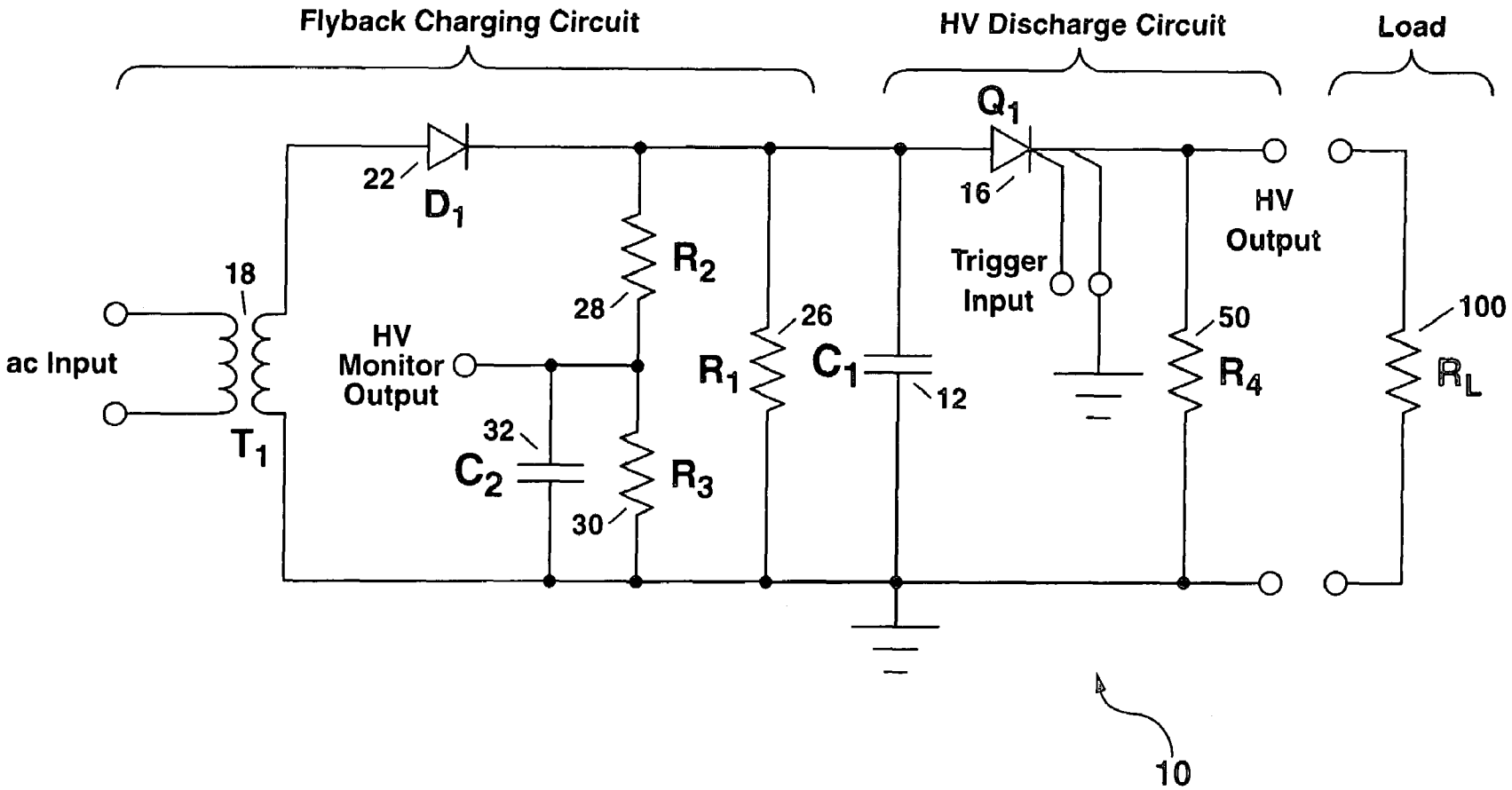
FIG. 3 shows a schematic circuit diagram for the monolithic CDU of FIGS. 1 and 2.

The transformer 18 in combination with the semiconductor diode 22 forms a flyback charging circuit as shown in FIG. 3. The flyback charging circuit can further include a high-voltage bleed resistor 26 ($R_1$) which is useful to bleed any charge off the capacitor 12 when the CDU 10 is not in use, or during the attachment of a load 100 to the CDU 10. The resistor 26 can have a resistance of, for example, 1000 megaohms (MΩ), with the exact resistance being selected in combination with the capacitance of the ceramic capacitor 12 to provide a predetermined RC time constant. Additionally, an optional voltage monitoring circuit can be included in the flyback voltage charging circuit. The voltage monitoring circuit can comprise a voltage divider formed by a pair of resistors $R_2$ 28 and $R_3$ 30 having a ratio $R_2/R_3$ of, for example, 1000:1 with a smoothing capacitor $C_{2\text{-}32}$ being provided across $R_3$ to provide a dc high voltage (HV) monitor output as shown in the schematic diagram of FIG. 3. The HV monitor output can be used in a feedback circuit (not shown) to control and stabilize the high ac output voltage from the transformer 18.

The thyristor switch 16 (indicated as $Q_1$ in FIG. 3) preferably comprises a metal-oxide-semiconductor (MOS) controlled thyristor (also termed a MOS-gated thyristor) which provides a high blocking voltage and a very high surge current capacity (e.g. up to several kiloAmps). The electrode 20' on a high-voltage side of the ceramic capacitor 12 can be extended partway over the major surface 14 as shown in FIG. 2 so that an anode side of the thyristor switch 16 can be attached directly to the electrode 20'. This eliminates the need for external wiring to the anode side of the thyristor switch 16 thereby reducing the inductance in a current loop from the ceramic capacitor 12 to the load 100 through the current switch 16. In some instances, the thyristor switch 16 can be attached directly to one of the metal plates on the high-voltage side 20' of the ceramic capacitor 12.

In the first embodiment of the present invention in FIGS. 1 and 2, a ceramic frame 34 can be attached onto the major surface 14 of the ceramic capacitor 12 to surround the thyristor switch 16. The ceramic frame 34 in combination with an overlying ceramic lid 36 forms an enclosure about the thyristor switch 16 and also provides a place on top of the lid 36 for attachment of the load 100 and other components of the CDU 10 (e.g. the resistors 26, 28 and 30 and the smoothing capacitor 32). The ceramic frame 34 can comprise a patterned metallization 38 as shown in FIG. 2 which can cover portions of both major surfaces thereof, with the patterned metallization 38 on the two major surfaces of the ceramic frame 34 being electrically connected together by a plurality of metallized vias 40 formed through the ceramic frame 34. The patterned metallization 38 forms low-inductance electrical connections between the electrodes 20 and 20' on the ceramic capacitor 12 and the ceramic lid 36. When the ceramic lid 36 is attached to the ceramic capacitor 12 with solder or an electrically-conductive epoxy, the solder or epoxy can also fill in the metallized vias 40.

In FIGS. 1 and 2, the ceramic lid 36 also comprises a patterned metallization 38' which covers portions of both major surfaces of the ceramic lid 36, with a plurality of vias 40' being formed through the ceramic lid 36 to connect the metallization 38' on the two major surfaces of the ceramic lid 36. The patterned metallization 38' provides an electrical connection to the electrodes 20 and 20' on the ceramic capacitor 12. Additionally, the patterned metallization 38' forms a trigger input electrode 42 which is electrically connected to a gate 44 on the thyristor switch 16 and is used to provide a trigger signal to turn on the thyristor switch 16 in order to discharge the ceramic capacitor 12 through the load 100 which is electrically connected on one side thereof to a cathode 46 of the thyristor switch 16 through a HV output terminal 48 formed from the patterned metallization 38'. The other side of the load 100 is electrically connected to a portion of the patterned metallization 38' which forms a ground electrical terminal that is electrically connected through the ceramic lid 36 and the ceramic spacer 34 to the low-voltage side 20 of the ceramic capacitor 12. An output resistor 50 (denoted $R_4$ in FIG. 3 and, for example, about 2 MΩ) can also be connected between the two output terminals in parallel with the load 100. When the thyristor switch 16 includes a second gate (i.e. a second trigger input) for turning the thyristor switch 16 off, the second trigger input is generally not needed for the CDU 10 and can be electrically grounded (see FIG. 3).

In the first embodiment of the CDU 10 of the present invention in FIGS. 1 and 2, the transformer 18 preferably comprises a low-temperature co-fired ceramic (LTCC) transformer 18. The LTCC transformer 18, which is shown by way of example in the exploded view of FIG. 4, comprises a plurality of ceramic sheets 52 which can be formed from a ferrite-based tape (e.g. comprising a nickel-zinc ferrite), with each ceramic sheet 52 being up to a few mils thick. Electrically-conductive traces can be formed on certain of the ceramic sheets 52 by depositing or printing an electrically-conductive material (e.g. a silver paste) onto the sheets 52 while the sheets 52 are in a tape form and in a "green" state (i.e. prior to firing or sintering of the sheets 52). This forms a plurality of coils 54. The ceramic sheets 52 can then be dried. A thin layer (not shown) of a dielectric material having a lower permeability than that of the ferrite-based tape can also be screen printed or pasted over the various ceramic sheets 52 proximate to the coils 54 to interact with the ferrite-based tape during a subsequent sintering step to lower the ferrite permeability and thereby provide an improved magnetic coupling within the LTCC transformer 18. Additionally, holes 56 can be punched or drilled (e.g. by mechanical or laser drilling) through the sheets 52 in the "green" state, as needed, and then the holes 56 can be filled with an electrically-conductive material (e.g. a silver paste) which can be screened onto the ceramic sheets 52 to form electrical connections between the coils 54, and to form a plurality of electrodes 58 on one or both major surfaces of the LTCC transformer 18.

Figure 4:
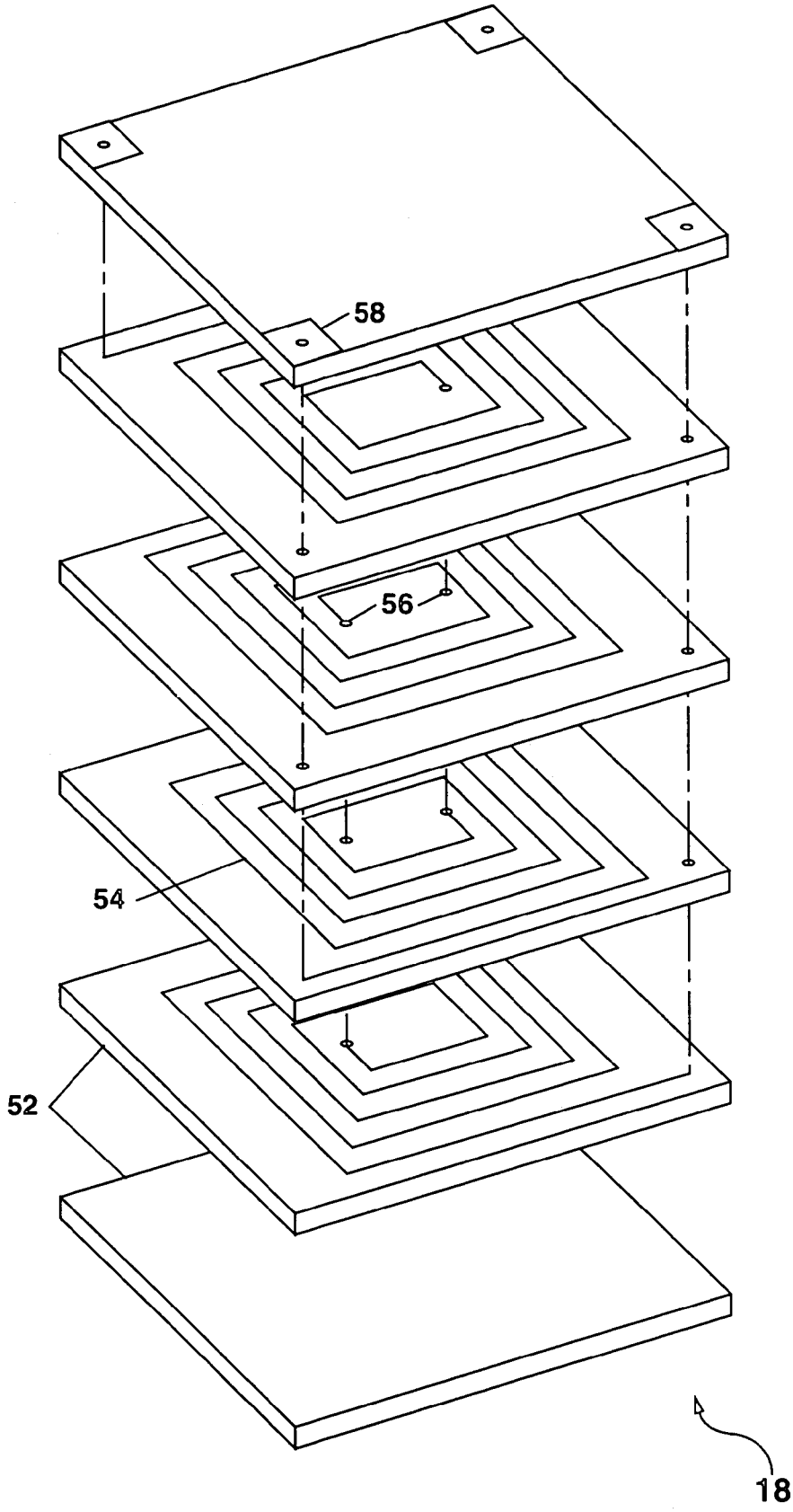
FIG. 4 shows a low-temperature co-fired ceramic (LTCC) transformer which can be used in the CDU of FIGS. 1 and 2.

In FIG. 4, alternating sets of the coils 54 are shown which can be electrically interconnected as indicated by the vertical dashed lines to form a primary winding and a secondary winding for the completed LTCC transformer 18. Once the various ceramic sheets 52 have been formed in the "green" state as described above, the ceramic sheets 52 can be stacked in the order shown in the example of FIG. 4 and laminated together (i.e. melded) under high pressure to form a solid mass. This can be done while the ceramic sheets 52 are in a tape form, with the laminated sheets 52 then being singulated to form the individual LTCC transformers 18 which can then be sintered at an elevated temperature in excess of 800° C. to remove any organic binders and plasticizers used to form the ferrite-based tape. The result is a solid monolithic LTCC transformer 18 which is expected to have a higher shock resistance than a conventional wire-wound transformer. Further details about the formation of LTCC transformers can be found in U.S. Pat. No. 6,198,374 which is incorporated herein by reference.

In FIGS. 1 and 2, the load 100 is shown as a slapper detonator which can be used to initiate an explosive pellet or charge (not shown) which is located proximate to the detonator. In this application, the CDU 10 can be used to form a firing set for initiating an explosive train. The slapper detonator can comprise a thin metal foil or semiconductor bridge which can be directly attached onto the CDU 10 and electrically connected to the ceramic capacitor 12 through the thyristor switch 16. Upon discharge of the capacitor 12 by providing a trigger signal to the thyristor switch 16, a relatively large electrical current of up to several thousand amperes is dumped into the slapper detonator 100 in FIGS. 1 and 2, thereby exploding the metal foil therein and setting off any explosive pellet or charge (not shown) that is located directly above the detonator 100. The CDU 10 of the present invention has a low parasitic inductance in a current path from the ceramic capacitor 12 to the load 100 so that a fast discharge of the energy stored in the capacitor 12 to the load 100 can be achieved. In some embodiments of the present invention, a current-viewing resistor can be inserted between the ceramic capacitor 12 and the load 100 to measure the magnitude and shape of a current pulse generated upon discharge of the ceramic capacitor 12.

Those skilled in the art will understand that the CDU 10 of the present invention can be used to energize other types of detonators known to the art. Furthermore, in other embodiments of the present invention, the detonator 100 can be microfabricated directly onto the ceramic lid 36 (see FIG. 8).

The CDU 10 of FIGS. 1 and 2 can also be used for other applications requiring a relatively high voltage and high electrical current discharge. These applications can include, for example, the initiation of a flashlamp (e.g. in a laser or a camera), the initiation of a plasma discharge (e.g. in a laser), or flammable gas ignition.

Figure 5:
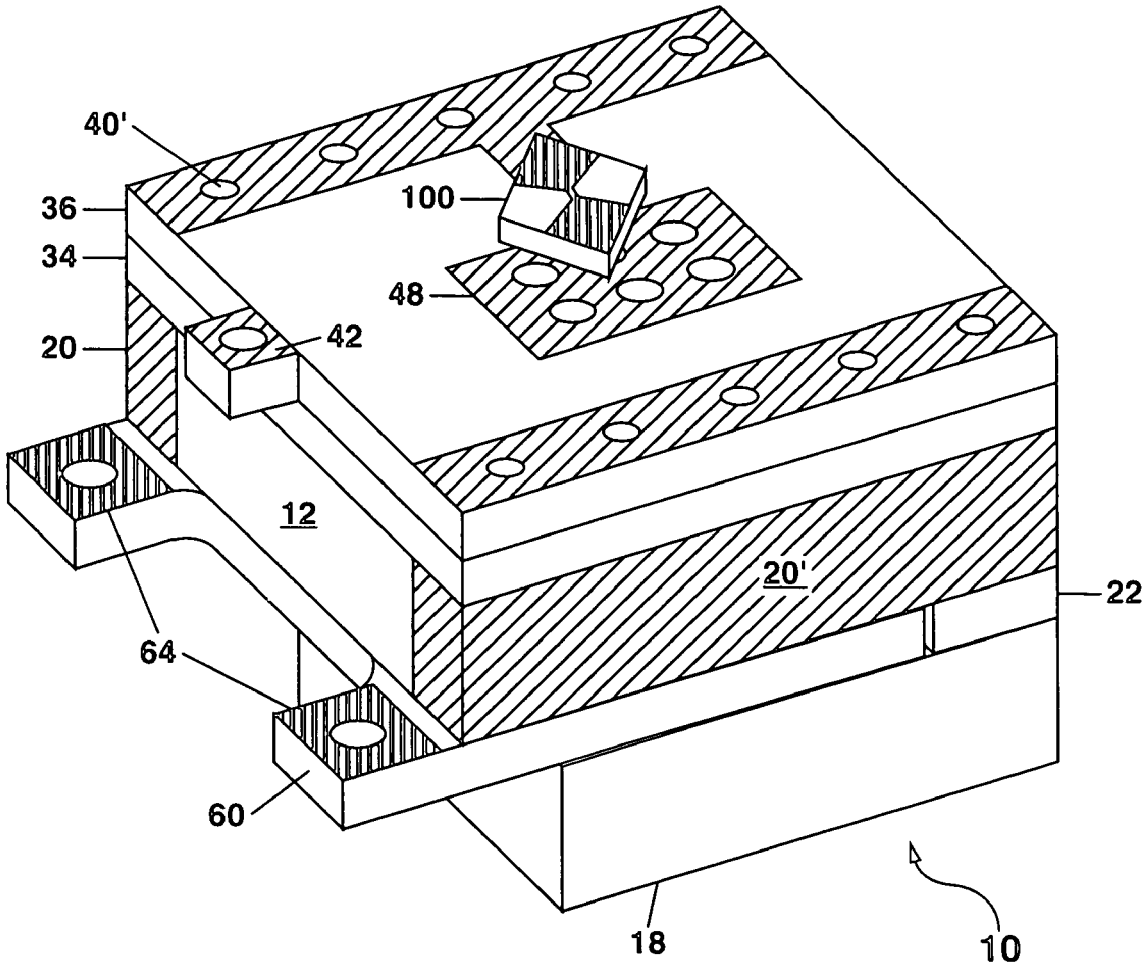
FIG. 5 shows a second embodiment of a monolithic CDU according to the present invention.
Figure 6:
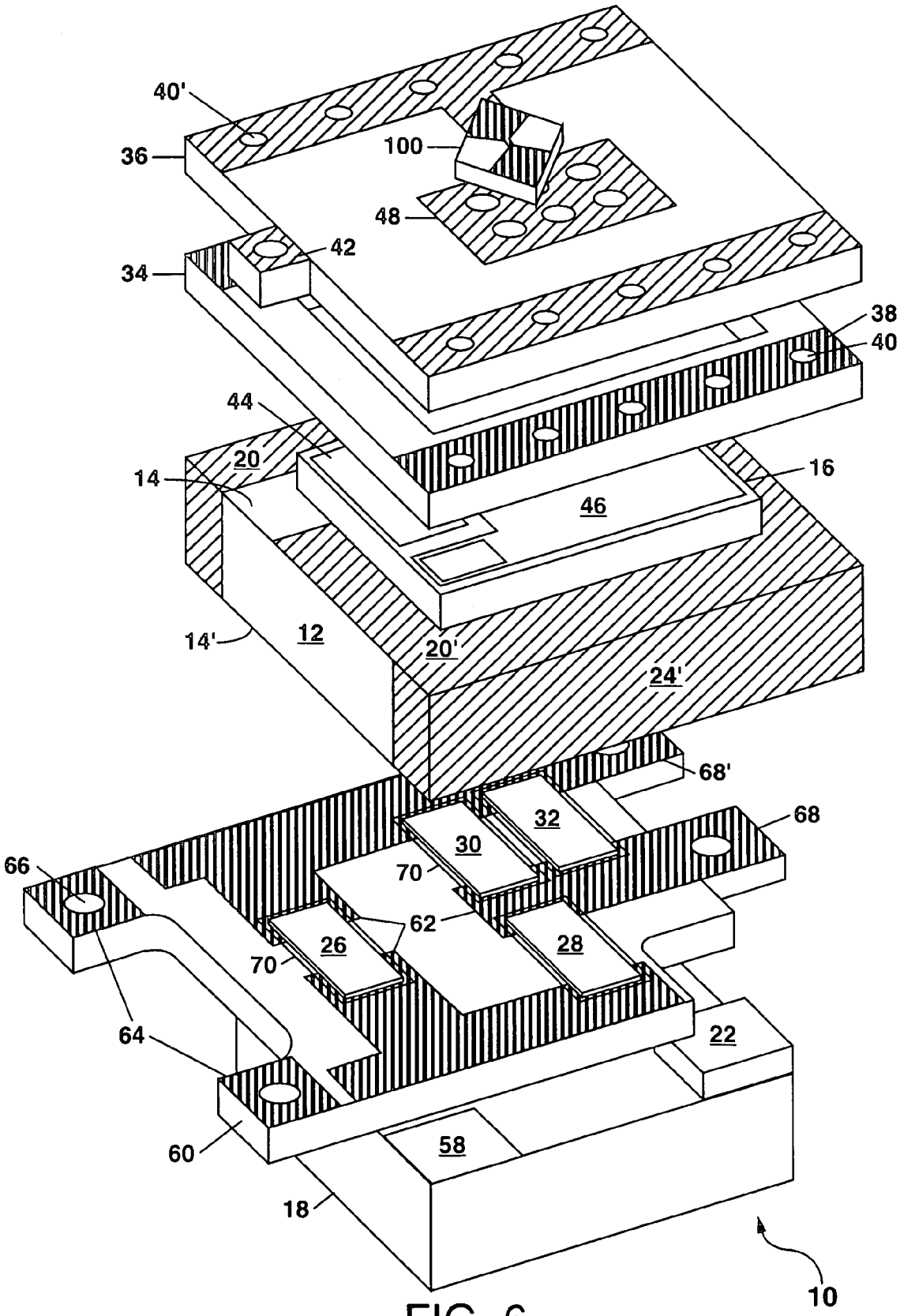
FIG. 6 shows an exploded view of the second embodiment of the CDU in FIG. 5.

FIG. 5 shows a schematic perspective view of a second embodiment of the CDU 10 of the present invention; and FIG. 6 shows an exploded view of the second embodiment of the CDU 10 of FIG. 5. In the second embodiment of the CDU 10, the various spacers 24 and 24' in the device of FIGS. 1 and 2 have been eliminated and have been replaced by a ceramic substrate 60 which includes a patterned metallization 62 on each major surface thereof. The use of a ceramic substrate 60 to form the CDU 10 allows the various resistors 26, 28 and 30 and the smoothing capacitor 32 to be located beneath the ceramic capacitor 12 rather than on the upper surface of the ceramic lid 36. This leaves the upper surface of the ceramic lid 36 for the attachment of a load 100 as shown in FIGS. 5 and 6, or alternately for the attachment of wires (not shown) for connection to an externally-located load 100.

Additionally, a pair of input terminals 64 can be provided on the ceramic substrate 60 in FIGS. 5 and 6 and connected to the electrodes 58 (i.e. primary input terminals) for the primary winding of the LTCC transformer 18. This can be done providing vias 66 through the ceramic substrate 60 with an inner sidewall of the vias 66 being metallized, and by using the patterned metallization on a lower surface of the ceramic substrate 60 to form an electrical connection to the primary input terminals 58 on the transformer 18. The vias 66 can also be sized to accept external wires (not shown) which can then be soldered in place. On an opposite side of the ceramic substrate 60 in FIGS. 5 and 6, a pair of output terminals 68 and 68' can be provided, with one output terminal 68 corresponding to the HV monitor output in FIG. 3 and being connected to a voltage divider circuit formed by resistors 28 and 30 and the smoothing capacitor 32. The other output terminal 68' can be used for a ground electrical connection to the CDU 10 with this output terminal 68' being electrically connected to the low-voltage side 20 of the ceramic capacitor 12 (see also FIG. 3).

The values of the various circuit elements 26, 28, 30 and 32 can be the same as described previously with reference to FIGS. 1-3. The various resistors 26, 28 and 30 can be formed either as chip components (e.g. thin-film or thick-film chip components) that are soldered or epoxied into frames 70 in the ceramic substrate 60, or as integrated resistors which can be formed directly on the ceramic substrate 60 (e.g. by deposition, direct writing or screen printing of a resistive paste or ink followed by a sintering step). In some embodiments of the present invention, the high-voltage bleed resistor 26 $R_1$ can be directly integrated onto one of the major surfaces 14 or 14' of the ceramic capacitor 12. The output resistor 50, can be similarly directly integrated onto a major surface of the ceramic lid 36 (see FIG. 8). The smoothing capacitor 32, when provided on the ceramic substrate 60 as shown in FIG. 6, can be provided as a chip element.

In the second embodiment of the CDU 10 of the present invention, the trigger input electrode 42 can extend outward from the ceramic lid 36 as shown in FIGS. 5 and 6 to facilitate soldering of an external wire thereto. In this case, a via 40' can be provided through the ceramic lid 36 and metallized to allow the trigger input electrode 42 to be electrically connected to a patterned metallization on the lower surface of the lid 36 and therefrom to the gate 44 on the thyristor switch 16.

The various elements of the CDU 10 of FIGS. 5 and 6 can be stacked and bonded together (e.g. using a solder reflow process or an electrically-conductive epoxy) to form the completed CDU 10. The load 100 (e.g. a detonator) can be bonded together with the CDU 10, or can be added at a later time.

Figure 7:
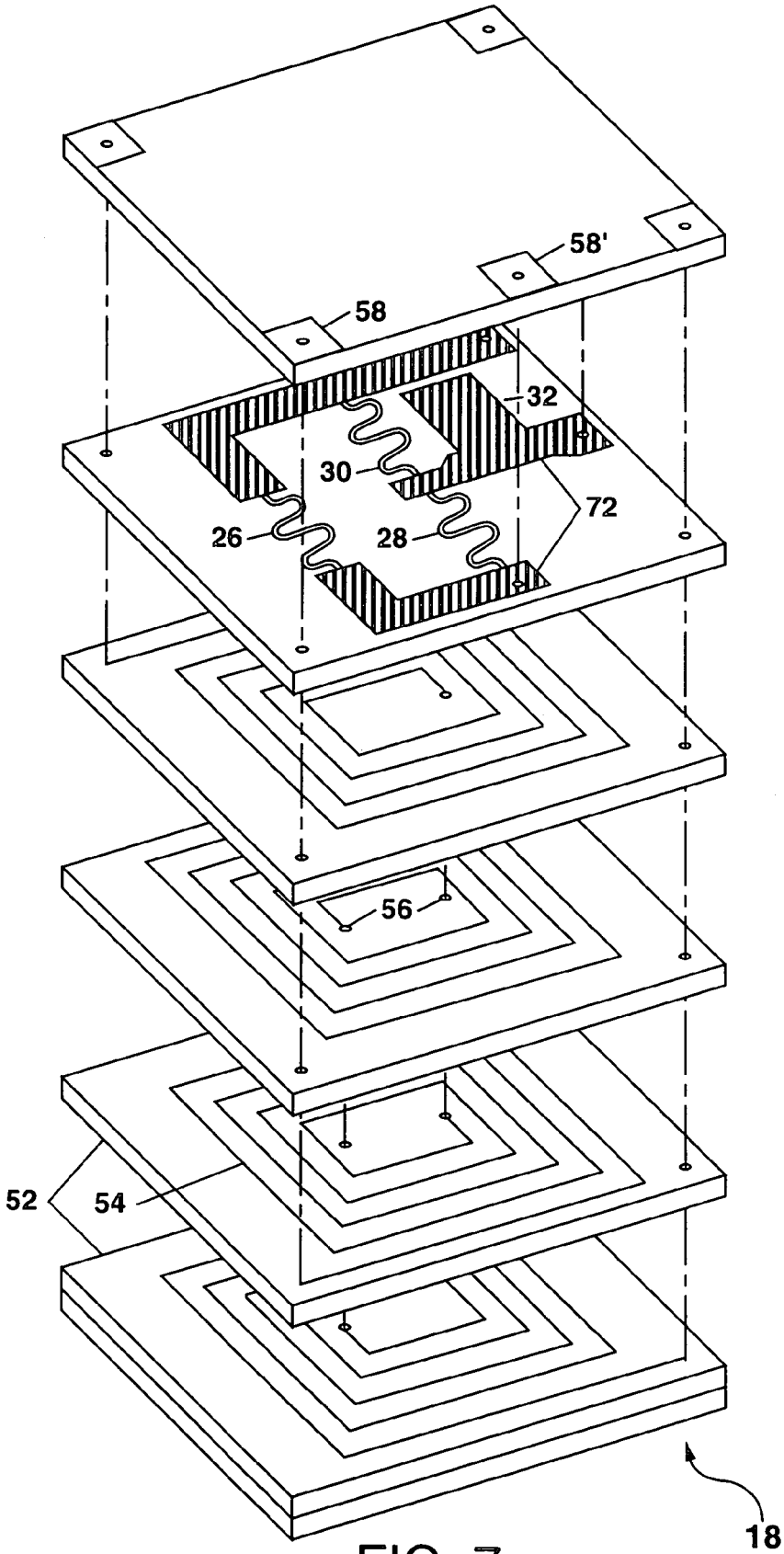
FIG. 7 shows an LTCC transformer having a plurality of passive electrical components formed therein for use in the CDU of the present invention.

In other embodiments of the present invention, the various resistors 26, 28 and 30 and the smoothing capacitor 32 can be directly integrated into the LTCC transformer 18. This can be done, for example, as shown in FIG. 7 by providing another ceramic sheet 52 in the LTCC transformer 18 just below the ceramic sheet 52 holding the electrodes 58, with the added ceramic sheet 52 having a patterned metallization 72 formed thereon to make electrical connections to the various resistors 26, 28 and 30 which can be formed directly on the ceramic sheet 52 having the patterned metallization 72 thereon by screening on or printing on a resistive paste or ink which will be sintered during co-firing of the transformer 18 as described previously with reference to FIG. 4. The smoothing capacitor 32 can also be formed within the LTCC transformer 18. This can be done by using superposed portions of the patterned metallization 68 to form a pair of capacitor plates, with the intervening ceramic sheet 52 forming the dielectric material between the capacitor plates.

An additional electrode 58' can also be provided as shown in FIG. 7 to provide an electrical connection to the high-voltage side (i.e. the electrode 20') of the ceramic capacitor 12 back to the LTCC transformer 18 and to the voltage divider circuit therein comprising $R_2$ and $R_3$. Another electrode 58" can be provided as a high-voltage monitor output from the voltage divider circuit.

When the various resistors 26, 28 and 30 and the smoothing capacitor 32 are formed within the LTCC transformer 18 as described above, the ceramic substrate 60 can include a patterned metallization thereon to provide the input terminals 64 and the output terminals 68 and 68' as shown in FIG. 6, but portions of the patterned metallization on the ceramic substrate 60 intended to provide electrical connections to the resistors 26, 28 and 30 and the smoothing capacitor 32 can be omitted, if desired, and additional portions of the patterned metallization on the ceramic substrate 60 can be provided to make the electrical connections to the LTCC transformer 18 and to the ceramic capacitor 12.

In other embodiments of the present invention, the various resistors 26, 28 and 30 and the smoothing capacitor 32 can be directly integrated onto one of the major surfaces of the LTCC transformer 18, generally the major surface of the LTCC transformer 18 which is attached to the ceramic substrate 60. This can be done in a manner similar to that described above for forming these passive elements of the flyback charging circuit inside the LTCC transformer 18. Generally, the semiconductor diode 22 will not be located within the LTCC transformer 18 due to the high-temperature processing required for sintering of the various ceramic sheets 52 forming the LTCC transformer 18.

In certain embodiments of the present invention, the LTCC transformer 18, the ceramic substrate 60 and the ceramic capacitor 12 can be formed as an assembly prior to adding the semiconductor diode 22, the thyristor switch 16, and other elements (e.g. the ceramic lid 36 and the load 100) of the completed CDU 10. The ceramic frame 34 can also be optionally included in this assembly. The LTCC transformer 18, ceramic substrate 60 and ceramic capacitor 12 and the optional ceramic frame 34 can be bonded together using an electrically-conductive epoxy or solder.

In some instances these elements can be bonded together using a low-temperature co-fired ceramic process whereby a metal paste (e.g. silver paste) is applied to form the various patterned metallizations and electrodes of the LTCC transformer 18, the ceramic substrate 60 and the ceramic capacitor 12 and the optional ceramic frame 34. These elements can then be stacked up and heated to an elevated temperature of about 800° C. or more to sinter the metal paste and bond the elements together to form the assembly. Once the assembly has cooled, the semiconductor diode 22, the thyristor switch 16, and other elements of the CDU 10 such as the ceramic lid 36 and a load 100 can be added and epoxied or soldered in place.

By assembling the elements 18, 60 and 12 and the optional ceramic frame 34 together as described above, a certain flexibility can be achieved for utilizing the CDU 10 of the present invention for different types of applications. Furthermore, piece part assembly is reduced since the stacked elements 18, 60 and 12 can be bonded together in a batch process by using a computer-controlled dispenser to provide the metal paste or electrically-conductive epoxy on predetermined portions of the elements 18, 60 and 12 and the optional ceramic frame 34 and by using a computer-controlled pick-and-place system to precisely stack up these elements so that they can be bonded together.

Figure 8:
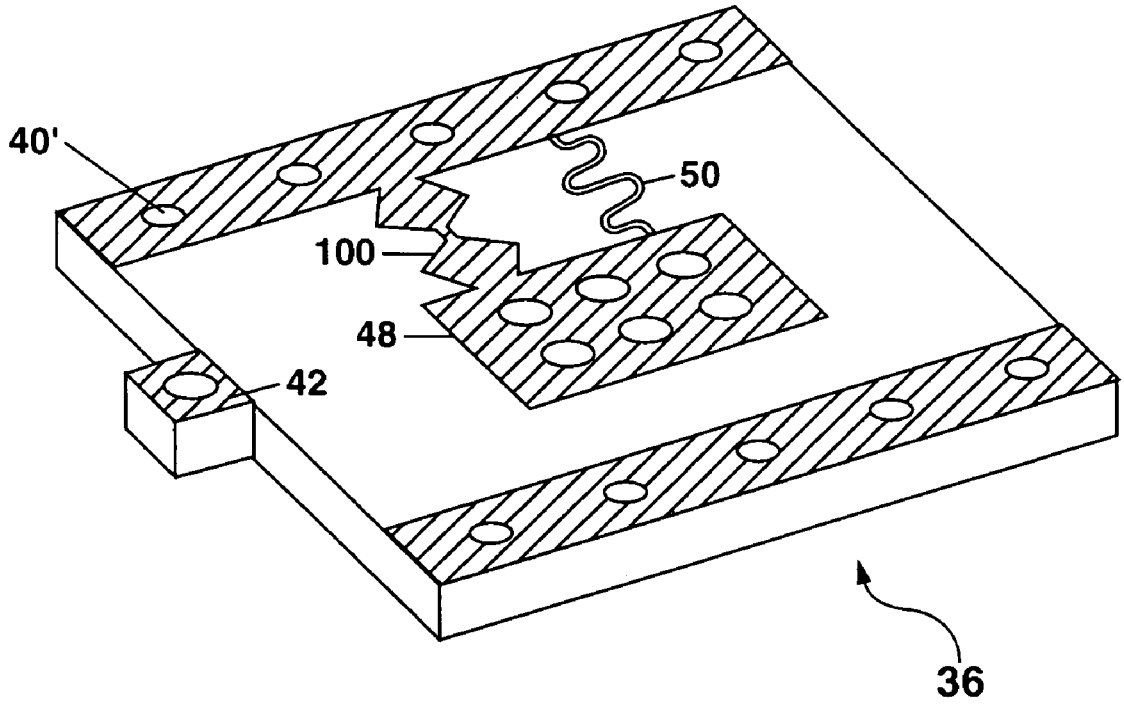
FIG. 8 shows a ceramic lid which includes an integral load in the form of a slapper detonator and also an integrated output resistor.

The load 100 in certain embodiments of the present invention can also be formed directly on the ceramic lid 36. In the case of a slapper detonator 100, this can be done, for example, by forming a patterned metallization directly onto the ceramic lid 36 as shown in FIG. 8. The ceramic lid 36 of FIG. 8 can be substituted into each embodiment of the present invention described heretofore, and can optionally include an integrated output resistor 50.

The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A capacitive discharge unit (CDU) for energizing a load, comprising:

(a) a ceramic capacitor for storing electrical energy;

(b) a thyristor switch attached onto one side of the ceramic capacitor and electrically connected thereto to discharge the electrical energy stored within the ceramic capacitor in response to a trigger signal provided to a gate of the thyristor switch; and (c) a flyback charging circuit comprising a transformer and a diode which are attached onto the side of the ceramic capacitor opposite the thyristor switch to provide the electrical energy to the ceramic capacitor for storage therein.

2. The capacitive discharge unit of claim 1 wherein the ceramic capacitor comprises a lead lanthanum zirconate titanate (PLZT) dielectric material separating a plurality of spaced-apart capacitor plates therein.

3. The capacitive discharge unit of claim 1 wherein the transformer comprises a low-temperature co-fired ceramic (LTCC) transformer.

4. The capacitive discharge unit of claim 1 further comprising a ceramic frame surrounding the thyristor switch, with the ceramic frame being attached onto the ceramic capacitor.

5. The capacitive discharge unit of claim 4 further comprising a ceramic lid attached onto the frame to enclose the thyristor switch.

6. The capacitive discharge unit of claim 5 wherein the ceramic frame and the ceramic lid further include electrical conductors formed thereon or therein to conduct the electrical energy stored within the ceramic capacitor through the thyristor switch to a pair of output terminals formed on an outer surface of the ceramic lid.

7. The capacitive discharge unit of claim 6 further comprising a load attached onto the ceramic lid between the pair of the output terminals, with the load being energized upon discharge of the ceramic capacitor.

8. The capacitive discharge unit of claim 7 wherein the load comprises a detonator.

9. A capacitive discharge unit, comprising:

(a) a ceramic capacitor having a pair of substantially coplanar major surfaces;

(b) a thyristor switch attached onto one major surface of the ceramic capacitor, with the thyristor switch being electrically connected to the ceramic capacitor to discharge any electrical energy stored therein through the thyristor switch in response to a trigger signal provided to a gate electrode of the thyristor switch; and (c) a flyback transformer attached onto another major surface of the ceramic capacitor and electrically connected thereto through a semiconductor diode to provide electrical energy to charge the ceramic capacitor.

10. The capacitive discharge unit of claim 9 wherein the thyristor switch comprises a metal-oxide-semiconductor (MOS) controlled thyristor switch.

11. The capacitive discharge unit of claim 9 wherein the flyback transformer comprises a low-temperature co-fired ceramic (LTCC) transformer.

12. The capacitive discharge unit of claim 9 further comprising a frame which surrounds the thyristor switch and is attached onto the major surface of the ceramic capacitor whereon the thyristor switch is located.

13. The capacitive discharge unit of claim 12 further comprising a lid attached onto the frame to enclose the thyristor switch.

14. The capacitive discharge unit of claim 13 wherein the frame and lid each comprise a ceramic material.

15. The capacitive discharge unit of claim 13 wherein the frame and lid each include electrical conductors to conduct the electrical energy discharged from the ceramic capacitor to a pair of output terminals provided on an outer surface of the lid.

16. The capacitive discharge unit of claim 15 further comprising a load attached onto the lid between the pair of output terminals, with the load being energized upon discharge of the ceramic capacitor.

17. The capacitive discharge unit of claim 16 wherein the load comprises a detonator.

18. A capacitive discharge unit, comprising:

(a) a substantially planar ceramic capacitor having two major surfaces;

(b) a low-temperature co-fired ceramic (LTCC) transformer attached onto a major surface of the ceramic capacitor and electrically connected thereto through a semiconductor diode to electrically charge the ceramic capacitor; and (c) a thyristor switch attached onto another major surface of the ceramic capacitor opposite the LTCC transformer, with the thyristor switch being electrically connected to discharge the ceramic capacitor upon triggering of the thyristor switch.

19. The capacitive discharge unit of claim 18 further comprising a first ceramic substrate for attaching the LTCC transformer to the ceramic capacitor, with the first ceramic substrate including a patterned metallization for electrically connecting the LTCC transformer and the semiconductor diode to the ceramic capacitor.

20. The capacitive discharge unit of claim 19 further comprising a second ceramic substrate located on a side of the thyristor switch opposite the ceramic capacitor, with the second ceramic substrate having a patterned metallization through which the ceramic capacitor is discharged upon triggering of the thyristor switch.

21. The capacitive discharge unit of claim 20 wherein the second ceramic substrate includes a pair of output terminals for the attachment of a load thereto, with the load being energized upon discharge of the ceramic capacitor.

22. The capacitive discharge unit of claim 21 wherein the load comprises a detonator.

23. The capacitive discharge unit of claim 20 further comprising a third ceramic located between the ceramic capacitor and the second ceramic substrate to enclose the thyristor switch, with the second ceramic substrate providing an electrical connection between the ceramic capacitor and the second ceramic substrate.

24. A capacitive discharge unit formed as a monolithic stacked assembly and comprising a ceramic capacitor sandwiched between a low-temperature co-fired ceramic (LTCC) transformer and a metal-oxide-semiconductor controlled thyristor (MCT) switch, the LTCC transformer being electrically connected to charge the ceramic capacitor through a semiconductor diode located therebetween, and with the MCT switch being triggerable to discharge the capacitor.

* * * * *